US008192257B2

(12) United States Patent
Chandrasekaran et al.

(10) Patent No.: US 8,192,257 B2
(45) Date of Patent: Jun. 5, 2012

(54) METHOD OF MANUFACTURE OF CONSTANT GROOVE DEPTH PADS

(75) Inventors: Naga Chandrasekaran, Boise, ID (US); Arun Vishwanathan, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 1037 days.

(21) Appl. No.: 11/400,707

(22) Filed: Apr. 6, 2006

(65) Prior Publication Data

US 2007/0238297 A1 Oct. 11, 2007

(51) Int. Cl.
*B24D 11/00* (2006.01)

(52) U.S. Cl. ..... 451/527; 451/528; 451/529; 451/531

(58) Field of Classification Search ..... 451/41, 451/59, 63, 285, 287, 526, 527, 528, 529, 451/531

See application file for complete search history.

(56) References Cited

U.S. PATENT DOCUMENTS

| | | | | |
|---|---|---|---|---|
| 5,533,924 | A | 7/1996 | Stroupe et al. | |
| 5,690,540 | A | 11/1997 | Elliott et al. | |
| 5,733,176 | A | 3/1998 | Robinson et al. | |
| 5,840,629 | A | 11/1998 | Carpio | |
| 5,934,980 | A | 8/1999 | Koos et al. | |
| 5,989,470 | A | 11/1999 | Doan et al. | |
| 6,039,633 | A * | 3/2000 | Chopra | 451/41 |
| 6,136,043 | A | 10/2000 | Robinson et al. | |
| 6,213,845 | B1 | 4/2001 | Elledge | |
| 6,672,951 | B2 * | 1/2004 | Walker et al. | 451/527 |
| 6,861,353 | B2 | 3/2005 | Vaartstra | |
| 6,872,132 | B2 | 3/2005 | Elledge et al. | |
| 6,899,611 | B2 * | 5/2005 | Reinhardt et al. | 451/527 |
| 7,037,177 | B2 * | 5/2006 | Kramer | 451/56 |
| 2003/0024169 | A1 | 2/2003 | Kendall et al. | |
| 2004/0038623 | A1 | 2/2004 | Chandrasekaran | |
| 2005/0020082 | A1 | 1/2005 | Vishwanathan et al. | |
| 2005/0051267 | A1 | 3/2005 | Elledge | |
| 2005/0136808 | A1 | 6/2005 | Kramer | |

OTHER PUBLICATIONS

RODEL Finishing Pads product literature, Rodel Finishing Pads Rev. 3.0 Feb. 1, 2002.

Pace Technologies, Polishing Pads, www.metallographic.com/71-PolishingPads.htm, Dec. 28, 2005, Copyright 2004.

Kim, C.B., et al., Polishing Performance of Double XY—Groove Pattern Pad for W-CMP Application.

* cited by examiner

*Primary Examiner* — Ellen P. Morgan

(74) *Attorney, Agent, or Firm* — Whyte Hirschboeck Dudek SC

(57) ABSTRACT

Processing pads for mechanical and/or chemical-mechanical planarization or polishing of substrates in the fabrication of microelectronic devices, methods for making the pads, and methods, apparatus, and systems that utilize and incorporate the processing pads are provided. The processing pads include grooves or other openings in the abrading surface containing a solid or partially solid fill material that can be selectively removed as desired to maintain the fill at an about constant or set distance from the abrading surface of the pad and an about constant depth of the pad openings for multiple processing and conditioning applications over the life of the pad.

19 Claims, 7 Drawing Sheets

METHOD OF MANUFACTURE OF CONSTANT GROOVE DEPTH PADS

FIELD OF THE INVENTION

The invention relates generally to semiconductor processing methods, and more particularly to processing pads used to polish and/or planarize workpiece substrates during the manufacture of a semiconductor device, and to apparatus and methods that utilize the pads.

BACKGROUND OF THE INVENTION

Chemical-mechanical polishing and chemical-mechanical planarization processes, both of which are referred to herein as "CMP" processes, are abrasive techniques that typically include the use of a combination of chemical and mechanical agents to planarize, or otherwise remove material from a surface of a micro-device workpiece (e.g., wafers or other substrate) in the fabrication of micro-electronic devices and other products. A planarizing or polishing pad ("CMP pad") is a primary component of a CMP system. The CMP pad is used with a chemical solution along with abrasives, which may be present in the solution as a slurry or fixed within the pad itself, to mechanically remove material from the workpiece surface.

FIG. 1 illustrates a conventional chemical-mechanical planarization (CMP) apparatus 10 with a circular table or platen 12, a carrier assembly 14, and a CMP pad 16. The planarizing apparatus 10 can have an under-pad or subpad 17 attached to a surface of the platen 12 for supporting the CMP pad 16. A drive-assembly 18 rotates the platen 12 (indicated by arrow "A") and/or reciprocates the platen 12 back and forth (indicated by arrow "B"), and the motion provides continuous movement of the CMP pad 16 relative to a workpiece 20 (e.g., a wafer) secured onto a substrate holder or carrier 22. In the illustrated embodiment, an actuator assembly 24 is coupled to the carrier 22 to provide axial and/or rotational motion to the carrier 22 as indicated, respectively, by arrows "C" and "D". Also as shown, the carrier 22 is coupled by an arm 28 to an actuator 26 that rotates (indicated by arrow "E") to "sweep" the carrier 22 along a path across the planarizing surface 30 of the CMP pad 16. Although not shown, the carrier 22 can also be a weighted, free-floating disk that slides over the CMP pad 16. Several nozzles 32 attached to the carrier 22 dispense a planarizing solution 34 onto the surface 30 of the CMP pad 16. In FIG. 2, another embodiment of a typical CMP processing apparatus is shown with a delivery system 36 having an arm 38 with a nozzle 32 for delivery of a slurry or planarizing solution 34 over the surface 30 of the CMP pad 16 during a planarizing operation, and nozzles 39 for a high pressure DI rinse to clean the pad.

In operation, the workpiece 20 and/or the CMP pad 16 are moved relative to one another allowing abrasive particles in the pad or slurry to mechanically remove material from the surface of the workpiece 20, and reactive chemicals of the planarizing solution 34 on the surface 30 of the CMP pad 16 to chemically remove the material. This action results in wear of the planarizing surface 30 of the CMP pad 16.

Conventional CMP pads are round or disk-shaped, planar, and have larger dimensions than the workpiece substrate. CMP pads are typically fabricated by forming the pad material into large cakes that are subsequently skived, or sliced, to a desired thickness, or by individually molding the pad. Pads can also be produced as individually molded or with abrasives embedded in the pad (fixed abrasive). The condition of the planarizing surface of the CMP pad is one variable affecting the polishing rate and uniformity of the polished surface if the workpiece substrate.

As shown in FIGS. 3-4, CMP pads have a thickness "T" and a planarizing surface 30. CMP processes use pads that typically include openings 40 (e.g., grooves, channels, perforations) having different grooving styles to improve process performance, which in the illustrated embodiment are in the form of grooves. The depth "D", width "W", and pitch "P" (i.e., distance between sidewalls or lands 41 of the grooves, etc.) of the openings 40 (e.g., grooves) affect the wafer to pad contact area and slurry transport across the wafer-surface. This, in turn, affects the uniformity of the planarized surface of the workpiece, the planarizing or polishing rate and capabilities, and defects in the workpiece surface.

Most CMP pads are initially received from the manufacturer with a hydrophobic, non-planar surface. Before use, the planarizing surface of the CMP pad typically undergoes a conditioning process to planarize and abrade (roughen) the surface so that effective planarization of the workpiece surface can be achieved. Typically, a hard CMP pad is conditioned using a rough or abrasive pad, such as a diamond or diamond-on-metal conditioning stone or pad. In some operations, the planarizing pad is removed from the platen and placed on a separate conditioning machine.

The planarizing apparatus 10 illustrated in FIG. 1 includes a second carrier assembly 42 that includes an actuator assembly 44 coupled to a carrier 46 and to an arm 48, which can be actuated to move the carrier 46 axially (indicated by arrow "F") and/or to rotate the carrier 46 (indicated by arrow "G") to engage the conditioning surface 50 of a conditioner or conditioning medium 52 against the planarizing surface 30 of the CMP pad 16. Exemplary conditioners 52 include, but are not limited to, pads, diamond brushes, and nylon brushes. The carrier assembly 42 can include an actuator 54 that operates to rotate the arm 48 (indicated by arrow "H") to move or sweep the conditioning pad 52 in an arcuate sweep path against the planarizing surface 30 of the CMP pad 16 between processing cycles. The conditioning pad 52 abrades the surface 30 of the CMP pad to planarize it, which prevents glazing of the pad surface and provides a fresh surface for polishing.

The condition of the planarizing surface of the CMP pad also changes over time from the collection of residual matter on the planarizing surface of the pad during the CMP operation, which can glaze over sections of the pad surface. The workpieces can also wear depressions into the surface of the CMP pad, resulting in a non-planar processing surface. Typically, a pad is also conditioned after processing of a number of workpieces to remove slurry residue and eliminate surface irregularities (e.g., protrusions, depressions), and restore the surface texture of the pad to a desired condition for planarizing additional workpieces.

Referring to FIGS. 4-5, wear and conditioning of the CMP pad leads to a decrease in the initial depth $D_1$ of the openings (e.g., grooves) to a reduced depth $D_2$, which can affect slurry flow dynamics and affects the useful wear life of the pad. For example, during processing, the flow of solution (slurry) across the pad results in abrasive particles of the slurry settling within the grooves of the processing surface of the pad. Over multiple applications, comparatively fewer particles settle into the grooves as the grooves become shallower, which is accompanied by an increasing amount of abrasive particles being present on the surface of the pad. This effect alters slurry efficiency and polish dynamics with respect to later-processed workpieces. Thus, a gradual reduction of the groove depth of a pad can affect the rate and uniformity of the polishing process over time, which can adversely impact later planarized workpieces. In practice, the number of device polishings for any given pad is tracked and the pad is then replaced after an experimentally determined number of cycles, generally before the pad is completely worn out or would damage the substrate being polished. This is also true in the case of pads with embedded abrasives in the form of posts standing up. The posts with abrasives tend to wear during polishing and conditioning.

One factor determining the life span of a CMP pad (i.e., the number of wafers processed per pad) is the depth "D" of the openings (e.g., grooves) in the CMP pad. For example, if a particular CMP process requires polishing using a pad having a shallow groove structure with the depth $D_1$ of the grooves at about 250 μm (about 10 mil) with a pad wear of about 0.25 μm/wafer (about 0.01 mil/wafer), with a continuing reduction in the groove depth to $D_2$ over time (and an associated reduction in pad thickness to $T_2$), the life of the pad will be only about 600-800 wafers processed. With a pad having a standard thickness $T_1$, of about 50-80 mil (about 1.3-2 mm), the pad should be capable of processing about 6000-8000 wafers with deeper initial grooving. Thus, although required by process specifications, the use of shallow grooves results in underuse of the pad and loss of valuable pad life, as well as the loss of operator time due to the need to repeatedly shut down the CMP apparatus to continually replace the CMP pad.

In manufacturing a pad, the initial depth $D_1$ of the openings (e.g., grooves) are machined to a specified depth into the pad thickness $T_1$, depending on the process requirements. However, there are also certain constraints on how deep the grooves can be formed into the body of the pad.

For example, there is some amount of movement of the lands 41 of the grooves 40 on the pad during a processing operation from the pressure applied by the contact and downforce of the workpiece onto the surface of the pad. Typically, the initial depth ($D_1$) of the openings is shallow extending into only about 30-40% of the total pad thickness ($T_1$) in order to provide a rigid and immovable pad surface for providing an acceptable planarizing effect. Consequently, about 60-70% of the pad thickness is unused.

However, forming the openings (e.g., grooves) deeper into the pad will result in shearing of the lands of the openings when the pad is put into contact with a wafer, rather than the land maintaining a relatively stiff, vertical stance due to a lack of supporting material adjacent to the lands. In addition, deeper grooves without any support can also cause sidewall collapse due to lack of stability and the viscoelastic nature of the pad materials. This limits the initial depth $D_1$ of the openings (e.g., grooves) within the pad.

In addition, deep grooves present pad cleaning challenges. The slurry particles and polishing debris tend to collect in the grooves. As shown in FIG. 2, high pressure DI rinse from the arm 38 using nozzles 32 is delivered to the pad between wafers to clean polishing debris from the pad. If the pad grooves are significantly deep, it poses challenges to pad cleaning. The debris that collects in the grooves can lead to defects on the polishing substrate (wafer) if not cleaned properly. Without properly controlled pad groove depth, it is difficult to clean the pads.

Therefore, it would be desirable to provide a CMP pad and process of planarizing a workpiece that overcomes such problems.

SUMMARY OF THE INVENTION

The present invention is directed to processing pads for mechanical and/or chemical-mechanical planarization or polishing of substrates in the fabrication of microelectronic devices, methods for making the pads, and methods and apparatus that utilize the processing pads.

In one aspect, the invention provides a processing pad in which openings (e.g., grooves, perforations, etc.) extending from the abrading surface of the pad are partially filled with a solid fill material that can be preferentially dissolved or otherwise removed from the openings in a controlled manner. Over multiple applications of the pad in a planarizing operation, as the thickness of the pad decreases due to use and abrasive action, the fill is maintained within the openings at a set distance from the abrading surface of the pad by removing the fill by application of a composition (different than a planarizing solution) selectively relative to the pad material, and/or by abrasive action.

The invention allows the fabrication of openings into a pad to up to 80% of the initial pad thickness, thus utilizing more of the pad thickness and extending the life of a pad to an increased numbers of applications relative to a standard processing pad. The presence of the fill material within the openings during a planarizing operation supports the lands (sidewalls) of the openings to prevent bending or shearing from pressures on the abrading surface of the pad by a substrate. The fill material can be provided in a solid form throughout its depth within the opening, or as a flowable (and curable) form with an overlying skin layer. A sufficient portion of the fill is maintained in the openings over the life of the pad to support the lands and to provide the required opening according to specifications of the processing operation at hand.

In one embodiment of a planarizing pad according to the invention, the fill material is composed of a polymeric material having a different chemical make-up than the pad, for example, a polymeric resist (e.g., a novolac resin, a diazonaphthaquinones, etc.). Exemplary compositions that can be applied to selectively dissolve the polymeric resist material within the openings in the processing pad include aqueous mixtures of hydrogen peroxide/sulfuric acid, an inorganic fluorine/organic acid, and ozonated water/acetic acid, and ammonium hydroxide solutions.

In another embodiment, the openings of the planarizing pad are filled with a material comprising water-soluble particles such as glucose, fructose, and other high molecular weight sugars, within a water-soluble binder (e.g., a calcium-based binder), which can be dissolved, for example, using an organic acid (e.g., citric acid, ascorbic acid, etc.), selectively relative to the pad material. Additional suitable water-soluble particles include water-soluble salts such as halide salts, and water-soluble gums or resins, for example, polyvinyl alcohol, and the like.

In another aspect, the invention provides processing methods for forming a planarizing pad. In one embodiment, the method includes filling openings in a planarizing pad to an about set distance from the pad surface with a flowable material and allowing the flowable material to solidify to form a fill, the fill being dissolvable upon contact with a composition selectively relative to the pad material. In another embodiment, the openings can be filled and excess fill material can be removed to a set distance from the pad surface, for example, by applying a composition to selectively dissolve the fill relative to the pad material, and/or by a buffing or abrading process. In yet another embodiment of a pad fabricating method, openings are formed in a processing pad to up to about 80% of the pad thickness, with a depth of at least about 50% of the pad thickness being preferred, and then filled with a flowable fill material. The openings can be filled, for example, by spinning a liquid material over the surface of the pad, or other method. The fill material can be hardened throughout, or cured to form a skin layer over a flowable underlayer.

In yet another aspect, the invention provides methods of planarizing a substrate. In one embodiment, the method comprises planarizing substrates by contact with the abrading surface of a pad according to the invention, and applying a composition to the surface of the pad to selectively remove a portion of the fill within the openings in the pad relative to the pad material to the about set distance from the pad surface. The steps of planarizing and applying the composition to remove additional fill from the pad openings can be repeated to process multiple substrates. In embodiments of the method utilizing a fill composed of a skin layer over a flowable material, after removal of fill from the openings, a portion of the fill can be cured or otherwise hardened to re-form the skin layer, and the pad continued to be used for planarizing additional substrates. In another embodiment, after planarizing the substrate(s), the abrasive surface of the pad can be conditioned, and the composition applied to the pad surface either during or subsequent to the conditioning step to remove fill from the openings.

In a further aspect, the invention provides systems for planarizing or polishing a workpiece substrate. An embodiment of a system according to the invention includes a planarizing or polishing apparatus comprising a processing pad according to the invention. In another embodiment, the system includes a substrate holder, a planarizing pad according to the invention, an actuator operable to move the workpiece substrate relative to the abrading surface of the planarizing pad, a source of a composition formulated to selectively dissolve the fill within the openings in the planarizing pad, and a dispenser for delivering the composition onto the abrading surface of the planarizing pad. The system can further include a carrier for a conditioning pad, and an actuator operable to move the conditioning pad relative to the abrading surface of the planarizing pad.

The dispenser for the composition can comprise, for example, spray elements spaced along a support connected to an actuator operable to move the support across the abrading surface of the pad. The spray elements can be configured to provide vertical and/or angled delivery of the composition onto the pad. In another embodiment, the dispenser can be situated on the substrate holder, and optionally be configured to deliver a planarizing solution onto the pad surface. In a further embodiment, the dispenser can be mounted on the carrier for the conditioning pad.

Yet another aspect of the invention is a conditioning system for a planarizing pad. An embodiment of a system adapted to condition an abrading surface of a planarizing pad includes a support for the planarizing pad, a carrier for supporting a conditioning pad, a mechanism adapted to move the conditioning pad in contact with the abrading surface of the planarizing pad, a source of a composition for dissolving the fill material within the pad openings, and a dispenser for delivering the composition onto the abrading surface of the pad.

The present invention advantageously provides a processing pad in which a constant groove depth can be maintained over multiple substrate polishings and conditionings of the pad surface, which advantageously improves process stability and significantly increases pad life. By keeping the groove depth to an optimum depth over multiple planarizing and conditioning cycles and the life of the pad, the slurry and planarizing dynamics remain about constant because the amount of abrasive particles that settle in the grooves and are present on the pad surface are maintained at an about constant level. This also improves slurry efficiency in a planarizing operation over multiple cycles of pad use and reconditioning. The invention eliminates process variations through the life of the pad due to changing groove depths.

The technique described herein to maintain a constant groove depth (opening depth) and/or constant height of pad lower areas from the polishing surface in a processing pad is compatible with current pad manufacturing techniques and practices. The present process provides flexibility to readily utilize processing pads having differing groove depths without compromising the integrity or life of the pad. Also, by maximizing the useful life of the polishing pad, fewer shutdowns are required, throughput and yield are increased, and operation downtime is minimized. In addition, by having properly controlled pad groove depth using the present invention, it is easier to clean the pads.

BRIEF DESCRIPTION OF THE DRAWINGS

Preferred embodiments of the invention are described below with reference to the following accompanying drawings, which are for illustrative purposes only. Throughout the following views, the reference numerals will be used in the drawings, and the same reference numerals will be used throughout the several views and in the description to indicate same or like parts.

FIG. 4 shows the initial pad, and FIG. 5 shows the pad at a subsequent processing step.

DETAILED DESCRIPTION OF THE INVENTION

Figure 1:
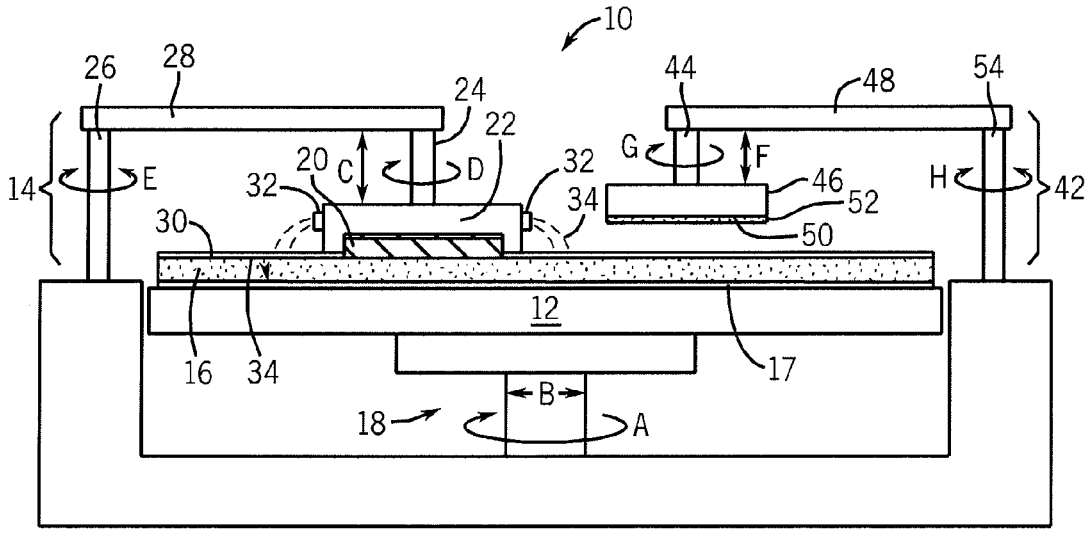
FIG. 1 (PRIOR ART)
FIG. 1 is a diagrammatic, elevational, cross-sectional view of an embodiment of a prior art planarizing apparatus.
Figure 2:
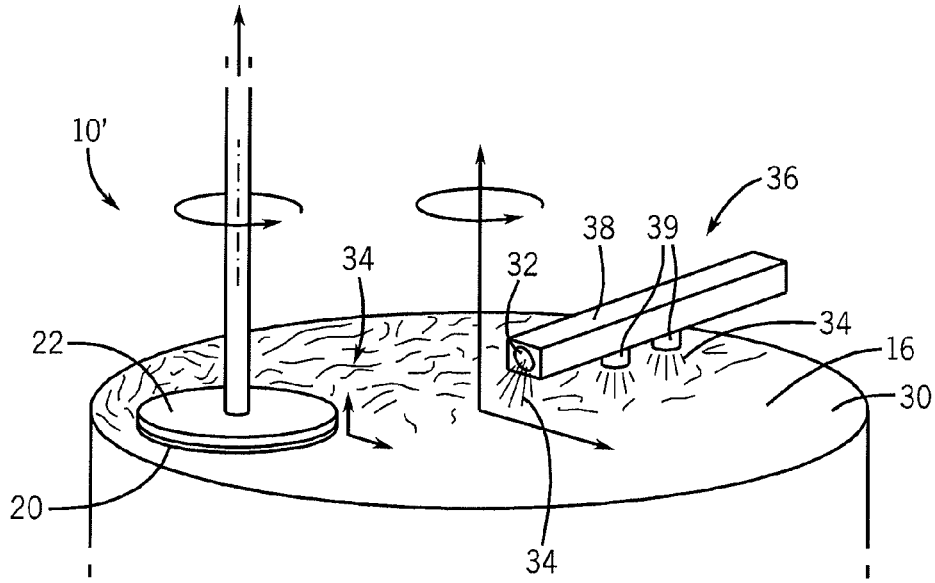
FIG. 2 (PRIOR ART)
FIG. 2 is a diagrammatic, isometric view of a prior art set up of another embodiment of a tool for performing CMP processing.
Figure 3:
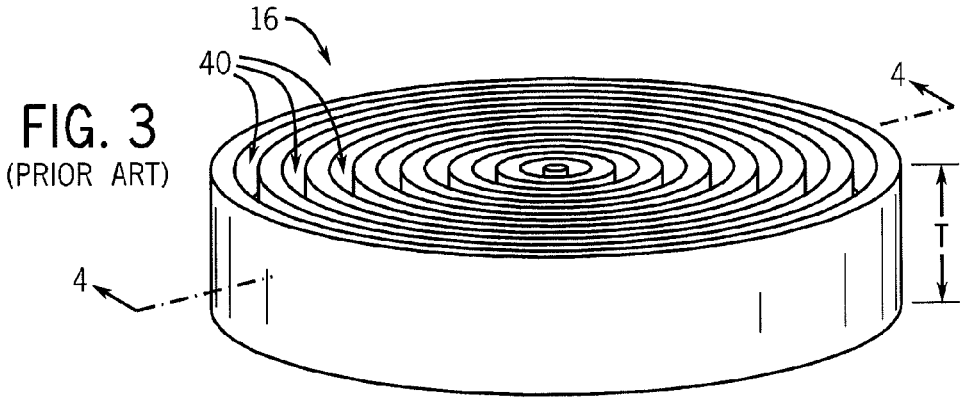
FIG. 3 (PRIOR ART)
FIG. 3 is a diagrammatic, isometric view of an embodiment of a prior art pad for planarizing a workpiece.

The invention is directed to planarizing pads, and methods of utilizing the planarizing pads in a mechanical and/or chemical-mechanical planarization of micro-device workpieces.

The invention will be described generally with reference to the drawings for the purpose of illustrating the present preferred embodiments only and not for purposes of limiting the same. Several of the figures illustrate processing steps in the fabrication and use of a planarizing pad in accordance with the present invention. It should be readily apparent that the processing steps are only a portion of the entire fabrication process.

In the context of the current application, the term "semiconductor substrate" or "semiconductive substrate" or "semiconductive wafer fragment" or "wafer fragment" or "wafer" will be understood to mean any construction comprising semiconductor material, including but not limited to bulk semiconductive materials such as a semiconductor wafer (either alone or in assemblies comprising other materials thereon), and semiconductive material layers (either alone or in assemblies comprising other materials). The term "substrate" refers to any supporting structure including, but not limited to, the semiconductive substrates, wafer fragments or wafers described above. The terms "micro-device workpiece" and "workpiece" are understood to include a variety of substrates in or on which micro-electronic devices, micro-mechanical devices, data storage elements, and other features are fabricated. For example, workpieces can be semiconductor wafers, glass substrates, dielectric or insulated substrates, and metal-containing substrates, among others. The terms "planarization" and "planarizing" refer to the removal of material from a surface by chemical-mechanical or mechanical planarization or polishing). The terms "chemical-mechanical polishing" and "CMP" refer to a dual mechanism having both chemical and mechanical components to remove material, as in wafer polishing. The terms "conditioning pad" and "conditioning stone" may encompass any structure suitable for abrading or otherwise conditioning a planarizing pad, including fixed diamond media, for example.

The following description with reference to the figures provides an illustrative example is in the fabrication of a planarizing pad (CMP pad) according to the invention, and methods of its use. Such description is only for illustrative purposes and the present invention can be utilized to provide other planarizing pads in other systems. The present invention is not limited to the described illustrative planarizing pads. The invention can also be applied using standard, commercially-available planarizing pads, which can be obtained from a variety of-sources.

Steps in an embodiment of a method for fabricating a planarizing pad 58 according to an embodiment of the invention are illustrated in FIGS. 6-13. The illustrated example is in the fabrication of a planarizing pad 58 in which the illustrated openings 60 are grooves in concentric circles (e.g., k-groove configuration) on the pad surface 62. The example is not meant to be limiting and the description applies to other openings (e.g., perforations, combination of grooves and perforations, etc.) that are formed in a planarizing pad and can be filled with the described fill material.

The CMP pads of any of the embodiments of the invention can be fabricated using a conventional pad material, for example, a thermoplastic polyurethane, polyvinyl, nylon, polymethylmethacrylate, polytetrafluoroethylene, natural and synthetic resins, among others, and can be filled or unfilled. The CMP pad can be produced by conventional processes, for example, but not limited to, casting, molding (injection molding, blow molding, etc.), sintering, and extrusion.

The CMP pad can be fabricated without abrasive particles embedded therein, to be used with a slurry planarization composition that includes abrasive particles. The CMP pad can also be in the form of an abrasive polishing pad ("fixed-abrasive pad") that is fabricated with abrasive particles fixed in the pad material, to be used with a planarization composition without abrasive particles therein.

The CMP pad 58 can be used in combination with a compressible subpad (e.g., element 17 in FIG. 1) such as a polyurethane foam or felt subpad, or a harder and less compressible subpad material, which can be adhesively attached together, or attached to the platen supporting the CMP pad.

The initial thickness $T_1$, of the CMP pad 58 can vary over a wide range. Typically, a CMP pad will have a thickness range of about 20-200 mil (0.5-5 mm), more typically about 50-120 mil (about 0.5-3 mm), and more typically about 80-100 mil (about 2-2.5 mm) total thickness.

Figure 6:
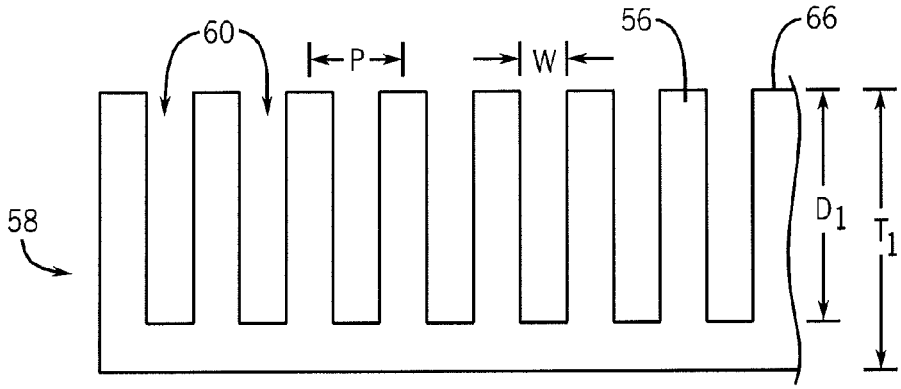
FIG. 6 is a diagrammatic, elevational, cross-sectional view of an embodiment of a CMP pad in accordance with the invention at an initial processing stage.

In a conventional pad fabrication process, openings 60 into the pad 58 are initially formed during fabrication or machined into the formed pad on a lathe or other suitable device. The openings 60 can be any style as desired, and are typically in the form of grooves, channels, and/or perforations extending into the pad in a desirable pattern. Exemplary configurations include concentric circles, spirals, X-Y cross-hatch pattern, K-groove, and K-groove/X-Y groove combinations, for example, and can be continuous or non-continuous in connectivity. In the illustrated example, the openings 60 are in the form of grooves, and as shown in FIG. 6, have an initial depth "$D_1$", width "W", and a pitch "P" (i.e., distance between openings), all of which affect the CMP operation.

Figure 4:
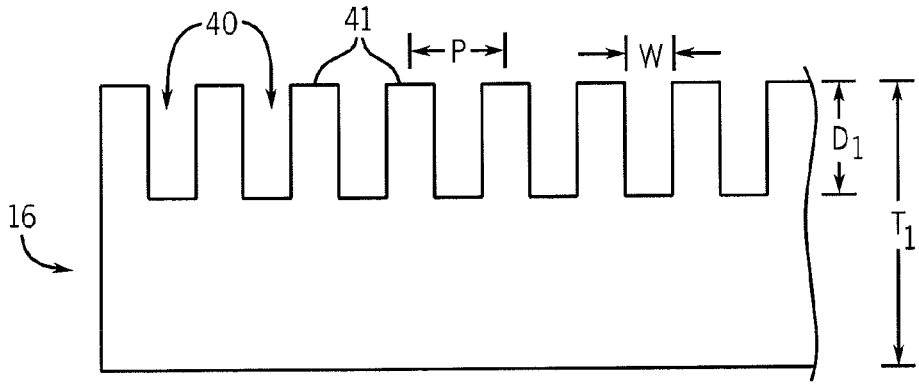
FIG. 4 (PRIOR ART)
FIGS. 4-5 are diagrammatic, elevational, cross-sectional views of the prior art pad shown in FIG. 3, taken along line 4-4.

In a conventional pad 16 (FIG. 4), the initial depth $D_1$ of the grooves 40 is about 30-50% of the initial pad thickness $T_1$. For example, with a grooved pad 16 having an initial thickness $T_1$, of about 80 mil (about 2 mm), the initial depth $D_1$ of the grooves 40 is typically about 30-50 mil (about 0.75-1.25 mm). Thus about 40-60% of the total thickness $T_1$ of the pad 16 is not utilized.

The inventive planarizing pad 58 differs from a conventional pad 16 in that the grooves 60 (or other openings) can be initially formed to a greater depth, which contributes to a longer life span (i.e., maximum number of wafers processed per pad) of the pad.

The present invention facilitates the initial formation of deep grooves 60 (or other openings) into the pad 58, which initial depth $D_1$ can be up to about 80% of the initial pad thickness $T_1$. For example, with a grooved pad 58 having an initial thickness $T_1$, of about 80 mil (about 2 mm), the grooves 60 can be formed to an initial depth $D_1$ of about 60 mil (about 1.5 mm) deep, or 75% of the pad thickness $T_1$. In a conventional pad 16, such a construction could lead to collapsing of the lands or groove sidewalls during planarization. However, in the inventive pad 58, the fill within the openings 60 supports the lands 56 of the grooves 60, and allows the pad 58 to be worked longer, resulting in fewer equipment changes on the CMP tool and quality control testing, among other advantages. In preferred embodiments of a planarizing pad according to the invention, the initial depth of the openings (e.g., grooves) are about 50-80% of the initial pad thickness $T_1$, more preferably about 60-80% of pad thickness $T_1$, more preferably about 70-80% of pad thickness $T_1$, and more preferably about 80% of pad thickness $T_1$.

According to the invention, a portion $D_x$, of the grooves 60 (or other openings) are filled with a solid material 62 such that only an upper segment $D_y$ of the opening 60 is exposed. As such, the surface 64 of the fill 62 within the opening is at a preset distance ($D_y$) from the pad surface 66, which, in effect, reduces the "working depth" of the opening 60. As an example, about 90% of the initial depth $D_1$ of the groove 58 can be filled with about 10% of the groove (depth) exposed. Any portion or ratio of the openings can be filled as desired according to the process requirements. Thus, the fill reduces the exposed portion of the openings from the initial depth $D_1$ (or $D_y$+$D_x$) to depth $D_y$, thus altering the effective or operative depth of the openings to provide a "working opening" (e.g., "working groove") having the desired or predetermined (set) opening depth $D_y$ for a particular planarization operation without compromising on pad stability or life time.

A suitable fill material 62 will at least partially solidify (e.g., cure) within the openings to a relatively hard matrix, and be selectively removed from the grooves relative to the pad material by chemical and/or mechanical removal, for example, by application of a suitable solvent to selectively dissolve or solubilize the material and/or by buffing.

The fill material 62 can be applied by any suitable process such that the material will deposit and/or flow into the pad openings 60 including, for example, spin-on processes, deposition processes (e.g., a chemical vapor deposition (CVD)). In another example, the fill material 62 can be in the form of a paste that can be extruded, laminated, or otherwise coated onto the pad surface 66 and made to flow into the grooves 60, for example, through heating. The fill can then be hardened to a limited depth or throughout its thickness by a process appropriate to the nature of the fill, for example, by curing, cooling, heating, or other suitable technique.

Exemplary fill materials include, for example, a polymer material such as a resist material, which will dissolve selectively relative to the pad material. by application of a solvent, and is chemically and reactively different than the pad material. Exemplary photoresists comprise an organic polymeric material, and include novolac resins and diazonaphthaquinones (DNQ). An organic polymer photoresist fill material can be wet etched by applying, for example, an aqueous mixture of hydrogen peroxide and sulfuric acid ($H_2SO_4/H_2O_2$), an aqueous mixture of an inorganic fluorine (e.g., hydrofluoric acid (HF), ammonium fluoride ($NH_4F$)) and an organic acid (e.g., citric acid, acetic acid), an ammonium hydroxide solution (e.g., tetramethyl ammonium hydroxide), ozonated DI water with acetic acid, and the like.

Another example of a fill is a material comprising water-soluble inorganic or organic particles such as an organic salt or a soluble polymer particle, dispersed in a water-soluble binder. Examples of water-soluble particles include high molecular weight sugars such as glucose, fructose, mannose, sucrose, lactose, maltose, dextrose, and starch; a soluble salt such as an inorganic halide salt, for example, sodium iodide (NaI), potassium chloride (KCl), potassium bromide (KBr), and ammonium fluoride ($NH_4F$); water-soluble gums or resins such as polyvinyl alcohol, polyvinyl acetate, pectin, polyvinyl pyrrolidone, hydroxyethyl cellulose, methyl cellulose, hydropropylmethyl cellulose, carboxymethyl cellulose, hydroxypropyl cellulose, polyacrylic acid, polyacrylamide, polyethylene glycol, polyhydroxyether acrylate, maleic acid copolymer, and polyurethane; among others. An average particle size diameter of the water-soluble particles may range between about 0.05-500 μm. Examples of water-soluble binders include calcium-based binders such as calcium acetate and calcium carbonate that will encapsulate the fill particles and break down by the application of an appropriate solvent, for example, an organic acid such as citric acid, tartaric acid, ascorbic acid, acetic acid, gluconic acid, malic acid, malonic acid, oxalic acid, succinic acid, gallic acid, formic acid, propionic acid, n-butyric acid, isobutyric acid, benzoic acid, and the like. Generally, the particles can be mixed with a binder at between about 0.5-70 wt %.

Figure 7:
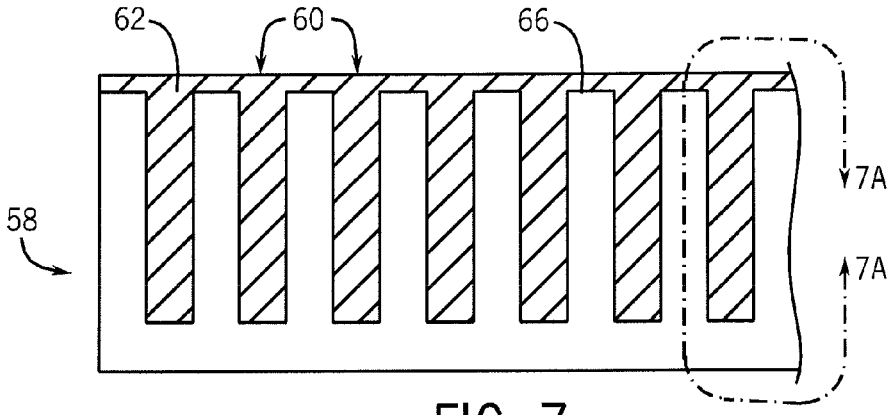
FIGS. 7-13 are diagrammatic, elevational, cross-sectional views of the FIG. 6 CMP pad at sequential processing steps subsequent to that of FIG. 6 according to an embodiment of the method of the invention.
Figure 8:
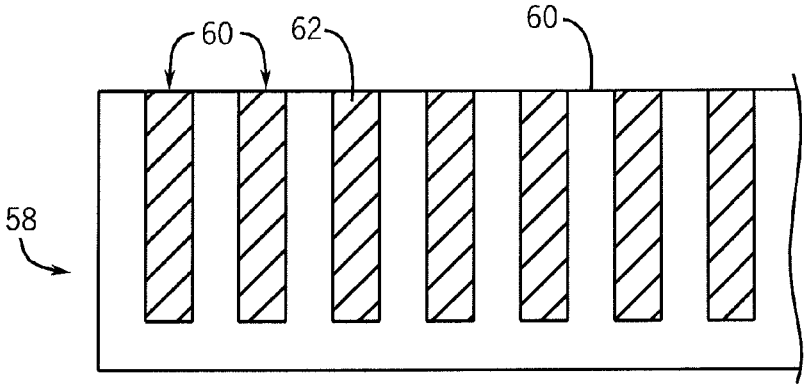

The fill material 62 can be applied to fill or partially fill the openings 60. As illustrated in FIG. 7, the fill material 62 has been applied such that excess material (overage) outside the openings 60 overlies the surface 66 of the pad 58. Such excess material can be removed from the pad surface 66 by a mechanical and/or chemical process, for example, by buffing with a conditioning pad, for example, and/or applying a solvent (e.g., a liquid) to solubilize the fill material, to expose the pad surface 66 with the fill material 62 remaining only in the openings 60, as shown in FIG. 8.

Figure 9A:
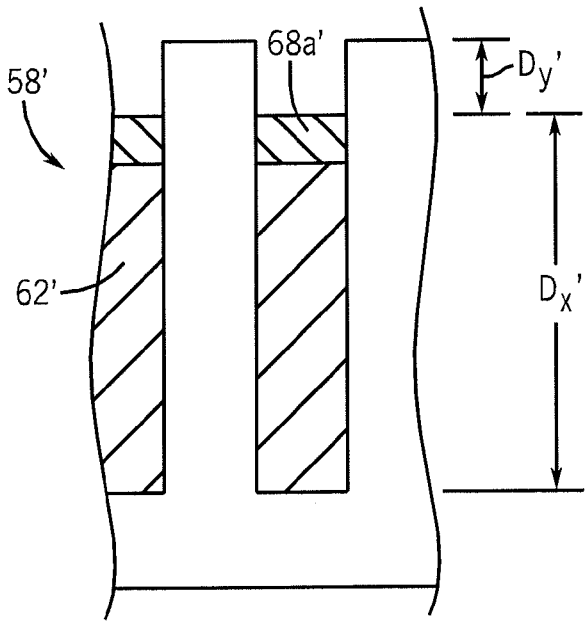
FIG. 9A is a diagrammatic, elevational, cross-sectional view of a CMP pad according to another embodiment of the processing step depicted in FIG. 9.
Figure 9:
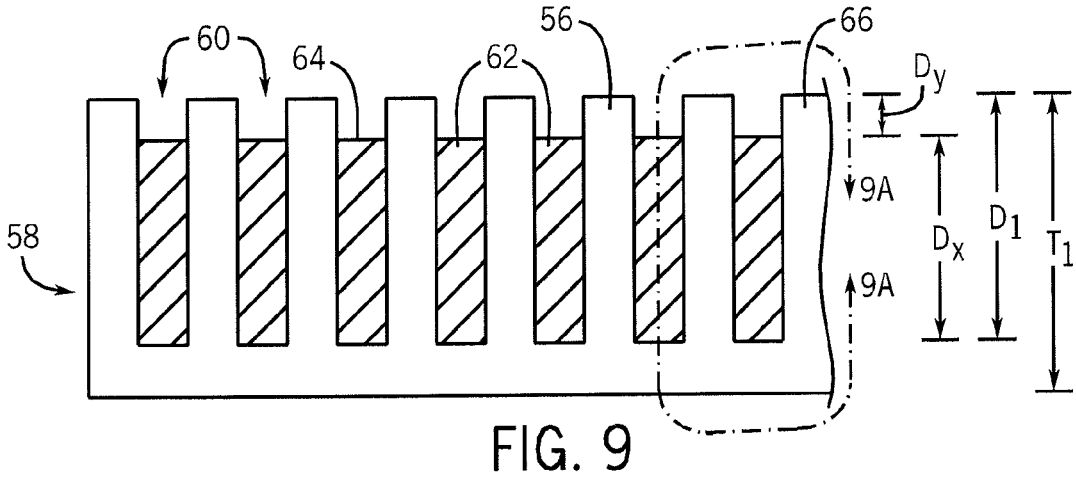

Referring to FIG. 9, a portion of the fill material 62 is removed as needed from the openings 60 to the predetermined depth $D_y$ according to process requirements. The remaining fill 62 within the grooves 60 having depth $D_x$, provides support to the lands 56 and prevents collapse of the grooved surface of the pad. The fill material 62 can be removed by a suitable process, for example, by buffing and/or applying a solvent that will selectively remove the fill material as desired relative to the pad material. Suitable solvents are those that will etch or dissolve (solubilize) the fill material at a controllable rate to avoid removal of an excess amount of fill from the openings. The solvent is also different from the chemistry of the planarizing solution used in the particular application. The solvent chemistry required to dissolve the fill material can be water-based (aqueous) or based on organic chemistries, depending on the chemistry of the fill material.

Figure 7A:
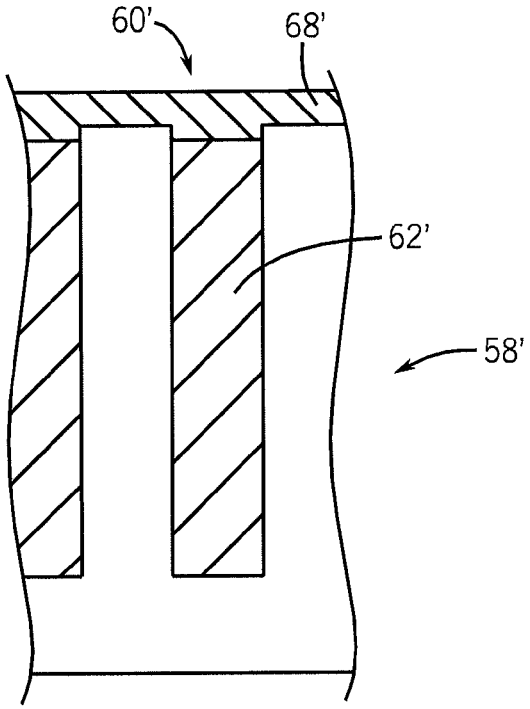
FIG. 7A is a diagrammatic, elevational, cross-sectional view of a CMP pad according to another embodiment of the processing step depicted in FIG. 7.

In another embodiment illustrated in FIG. 7A, after applying a liquid fill material over the pad surface 66' and into the openings 60', the fill material 62' can be partially solidified or hardened to form a skin-like surface layer 68', for example, about 1-2 mils thick (about 0.025 to 0.052 mm). For example, the pad 58' can be coated with a UV-curable polymer, which can be exposed to UV light to cure a surface layer 68' on the fill layer 62'. Excess fill 62' can be removed from the surface 66' of the pad and from the openings 60' to the desired depth $D_y'$ by buffing or abrading with a conditioning pad, for example, and/or by applying an appropriate solvent to solubilize the fill. Referring to FIG. 9A, the remaining fill 62' within the openings can then be partially solidified or hardened to form another skin-like surface layer $\mathbf{68}^{a'}$. After performing subsequent planarizing steps, the skin-like surface layer $\mathbf{68}^{a'}$ and additional underlying fill material 62' can be removed to the desired depth $D_y$ within the openings, and the fill can be re-cured or otherwise hardened to form another skin-like surface layer (similar to $\mathbf{68}^{a'}$).

The invention provides the ability to vary the working depth $D_y$ of the groove according to process requirements. For example, the pad grooves can be filled to provide an initial working depth $D_{y(l)}$ of about 100 μm and, at a later processing application, the fill can be removed to provide a working depth $D_{y(2)}$ of about 700 μm.

During CMP processing of a workpiece (e.g., FIG. 1), a planarizing solution is used that is compatible with the fill component, such that a minimal amount of the fill is removed from the pad openings. For example, a solution for planarizing a copper layer using a CMP process is typically neutral to acidic and includes an oxidizer (e.g., hydrogen peroxide) to oxidize the copper and increase the copper removal rate. The fill material utilized in such application would be compatible with the slurry solution such that a minimum amount of the fill up to about 1 mil (0.025 mm) is removed.

After planarizing, a cleaning solution (e.g., water or other solution) is typically applied to the pad under pressure to remove slurry and planarizing debris from the surface of the pad (not shown).

Figure 10:
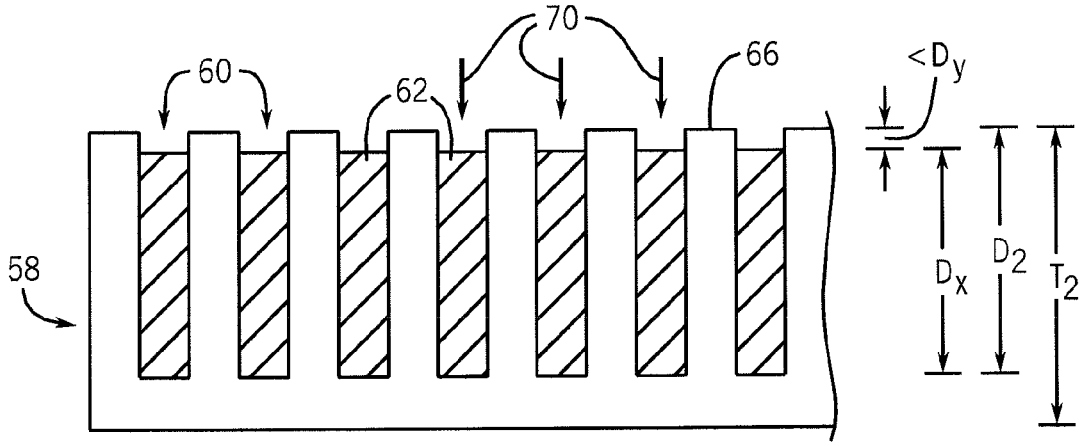

During processing on a CMP tool, abrading contact of the CMP pad 58 with the workpiece surface removes a portion of the land areas 56 of the grooves 60, thus reducing the thickness of the pad (to $T_2$) and the total depth of the grooves (to $D_2$), and the depth of the exposed portion of the openings 60 to less than the specified preset depth (i.e., to less than $D_y$), as depicted in FIG. 10, which can alter the slurry dynamics and planarization of the workpiece.

Figure 5:
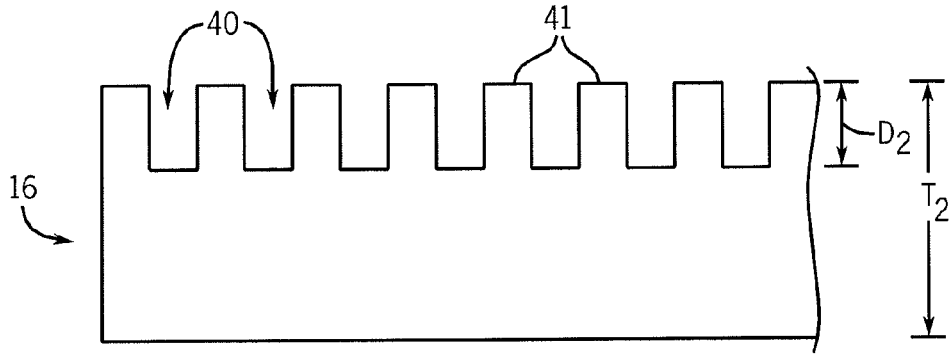
FIG. 5 (PRIOR ART)

To reestablish and maintain the depth of the exposed portion of the openings 60 (and the surface 64 of the fill 62 from the pad surface 66) to the preset depth $D_y$, a portion of the fill material 62 can be mechanically and/or chemically removed (FIG. 10, arrows 70) from the openings 60 to the desired depth. The fill material 62 is preferably etched at an about constant rate in order to maintain the fill at the desired depth $D_y$. This provides an about constant opening depth $D_y$ throughout a CMP processing operation. By comparison, on a standard pad 16, the depth of the openings 40 decreases ($D_1$ to $D_2$ in FIGS. 4-5) during CMP processing due to continuous abrasion and decreasing height of the lands 41 of the grooves 40.

Figure 11:
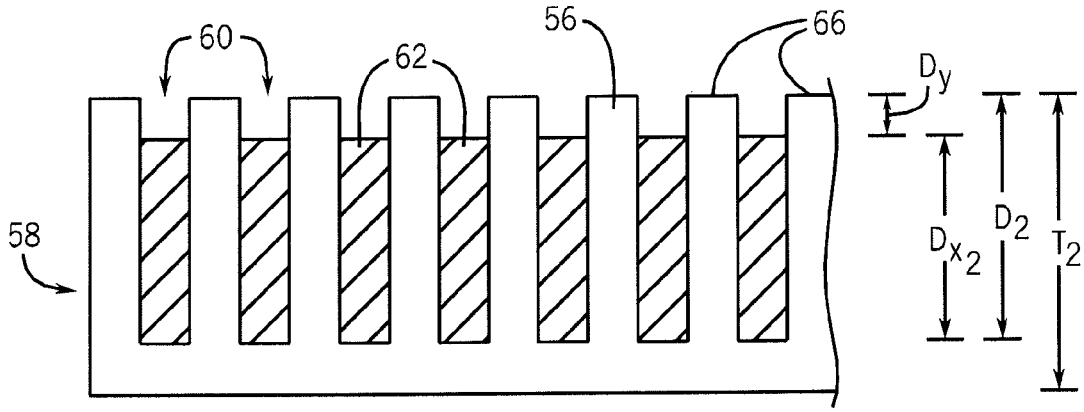
Figure 12:
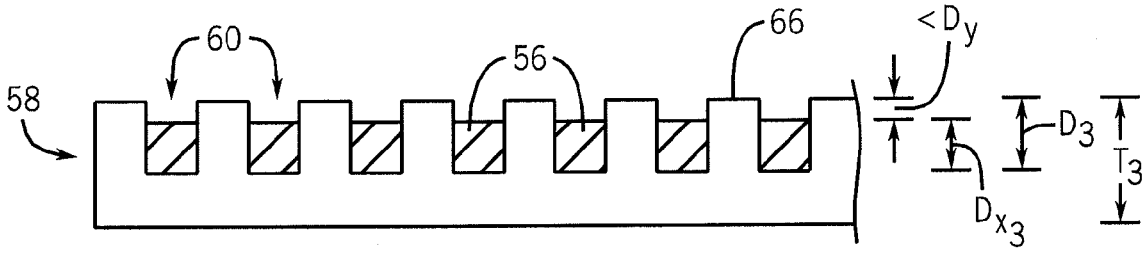
Figure 13:
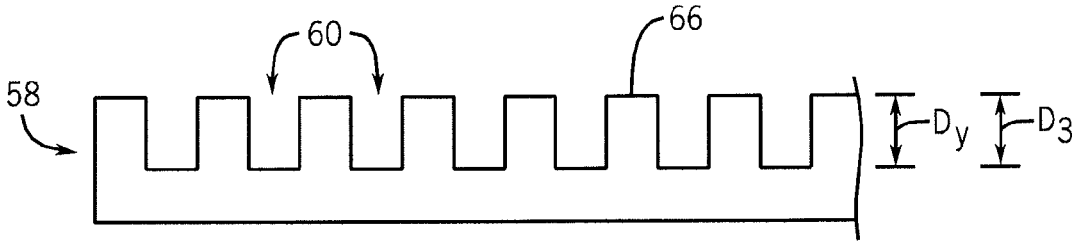

The fill removal step (arrows 70, FIG. 10) can be performed after planarizing step removing a workpiece from the CMP tool, for example, by buffing the surface 66 of the pad 58 or by wet etching with an appropriate solvent to selectively remove the fill material 62 to the predetermined depth $D_y$ within the openings 60, as shown in FIG. 11, thus reducing the total depth of the fill to $D_{x2}$. Additional planarizing and fill removal steps $\mathbf{70}_{(2)}$ can be performed, eventually resulting in the structure shown in FIG. 12, whereby the depth $D_{x3}$ of the fill 62 is about equal to the preset depth $D_y$ of the "working" groove, and the remaining fill in the grooves 60 is removed (FIG. 13).

A fill-removal solvent 72 is applied so as to assure that the etching is uniform across the surface 66 of the pad 58. The solvent can be delivered by any suitable method, for example, using a solvent delivery system 74 as illustrated in an embodiment of a CMP apparatus 76 in FIG. 14, as a high pressure spray bar system having spray nozzles 78 positioned at intervals along an arm or bar 80 that delivers an appropriate solvent 72 (e.g., water or other chemistry) while the pad 58 is rotating to ensure uniform etching of the fill material across the pad surface 66. The spray bar 80 is connected to a sweep actuator 82 that rotates (indicated by arrow "F") to sweep the spray bar across the surface 66 of the CMP pad 58. The nozzles 78 can also be connected to a line for delivery of a pad cleaning solution. As shown, the spray bar 80 can also include a nozzle 84 for delivery of a slurry or planarizing solution 86 onto the pad surface.

Solvent delivery parameters can be varied according to the nature of the fill material to effectively remove the desired amount of fill from the openings, including, for example, the pressure of the spray delivered through the nozzles 76, the angle of delivery onto the pad 58 (e.g., 90° angle, 45° angle to the pad, etc.), the duration of solvent application, the temperature of the solvent, the concentration of the solvent, and the like. Solvent delivery can also be varied according to the size of the CMP pad, and the rotational speed of the pad, among other factors.

Figure 14:
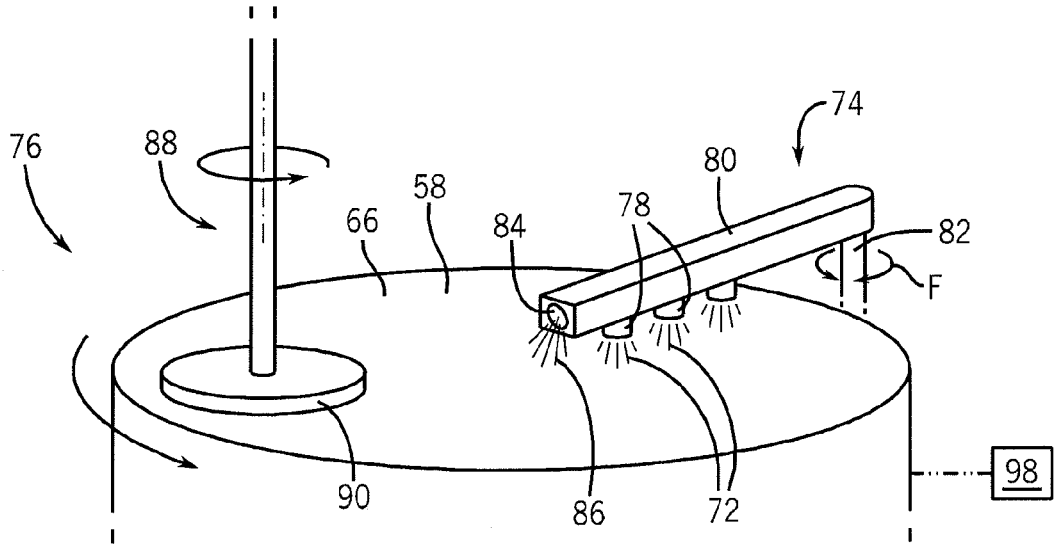
FIG. 14 is a diagrammatic, isometric view of an embodiment of a conditioning apparatus according to the invention, having a high pressure spray bar system.

The CMP system 76 illustrated in FIG. 14, also includes a conditioning assembly 88. During delivery of the fill removal chemistry 72, the pad 58 can optionally be conditioned using a conditioning pad 90, which can be used to distribute the fill removal solvent 72 and to apply a downward pressure as needed such that the solvent is uniformly applied across the surface of the CMP pad 58.

Figure 15:
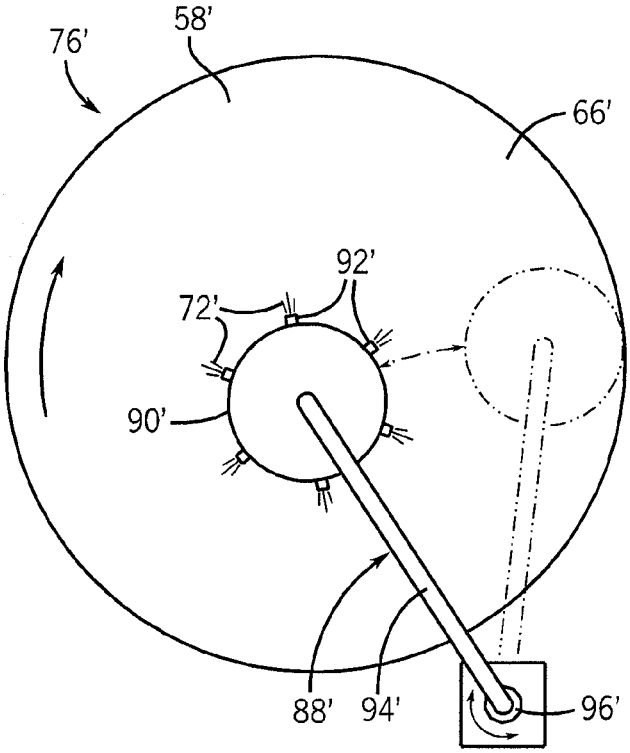
FIG. 15 is a diagrammatic, top view of another embodiment of a conditioning apparatus according to the invention.
Figure 16:
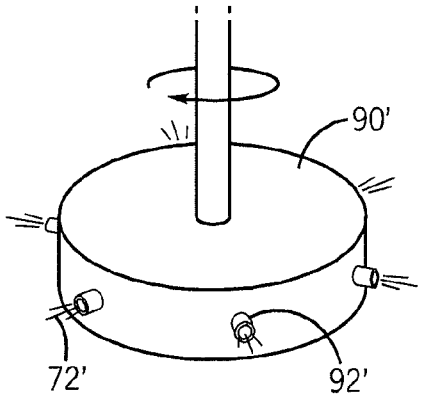
FIG. 16 is a diagrammatic, isometric view of the conditioning pad depicted in the apparatus of FIG. 15.

Referring to FIGS. 15-16, in another embodiment of an apparatus 76' that includes a conditioning assembly 88', the conditioning pad 90' can be structured to incorporate a delivery system for the fill-removal solvent 72' through nozzles 92' connected to a solvent supply source (not shown). The conditioning pad 90' can be connected to an arm 94' and sweep actuator 96', and swept or moved across the pad 58' in a conditioning procedure while delivering the fill removal solvent 72' onto the pad surface 66'.

The conditioning pad can be moved over the pad surface at varying rates to provide a longer dwell or residence time at different regions of the pad depending on the extent of the fill removal that is desired and to provide uniformity in the removal of the fill material from the openings. For example, the system can be programmed such that the dwell time of the conditioning pad is about 1% at the center of the pad and about 25% near the edge of a wafer.

The fill removal step 70 can be automated through software within the CMP system 76 for performance after a predetermined number of workpieces (e.g., wafers) have been processed, for example, after every 10 or 100 wafers, etc., depending on the particular CMP process and the rate of change or deviation of the pad (i.e., the lands) and/or the depth of the exposed portion of the openings, which can be experimentally determined.

The CMP apparatus 76 can also include a monitoring system 98 that will alert the operator, for example, when the thickness and/or uniformity of the wafer or other workpiece are outside a set specification and acceptable deviation (e.g., ±2%), and it is time to re-establish the desired depth $D_y$ of the grooves 60 or other openings. Such monitoring systems are known in the art, for example, as described in U.S. Pat. Nos. 6,213,845 and 6,872,132 (Elledge) and commercially available.

The monitoring system 94 can also comprise a device that measures groove depth, and when the "working" groove depth is not within an acceptable deviation (e.g., ±2%) of the preset depth $D_y$, the fill-removing step can be automatically triggered. Such groove depth measurement systems are known in the art, for example, as described in U.S. Publication No. 20050051267 (Elledge).

The etching or removal of the fill material can also be varied across the surface of the CMP pad, for example, from the center to the edge. This can be achieved, for example, by changing the concentration of the solvent, varying the pressure of the solvent delivery (e.g., 50 mls/minute in the center of the wafer to 200 mls/minute near the edge of the wafer), and varying the angles of the nozzles 78 and spray delivery along the delivery arm 80 to deliver more solvent along the outer edge of the pad than at the center of the pad.

The elements of the present CMP system are designed for compatibility such that the fill-removing solvent selectively removes the fill material and does not react with and is compatible with the pad material, the planarizing solution selectively removes the targeted material(s) on the workpiece and does not substantially remove or react with the fill material (or the pad material), and the chosen fill material is compatible with the planarizing solution.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A planarizing pad, comprising:

a pad material having a thickness and a plurality of openings extending from a surface into the pad and having a depth less than the thickness of the pad, and a solid fill material partially filling the openings such that the pad material extends beyond a surface of the solid material, the solid fill material consisting essentially of water-soluble particles within a water-soluble, calcium-based binder;

the water-soluble particles selected from the group consisting of high molecular weight sugars, water-soluble salts, water-soluble gums and water-soluble resins, said solid fill material compatible and substantially non-removable with a planarizing solution used with the pad during a planarizing or polishing operation and dissolvable upon contact with a composition selective to the solid fill material relative to the pad, the pad being devoid of abrasives.

2. The planarizing pad of claim 1, wherein the solid fill material is dissolvable upon contact with a composition that is different than a planarizing solution used with the pad during a processing operation.

3. The planarizing pad of claim 1, wherein the openings have a depth of up to about 80% of the pad thickness.

4. The planarizing pad of claim 1, wherein the openings have a depth of about 50-80% of the pad thickness, and the solid fill material fills the openings to a distance from the pad surface.

5. The pad of claim 1, wherein the openings comprise grooves, perforations, or a combination thereof.

6. The pad of claim 1, wherein the openings are in a pattern selected from the group consisting of concentric circles, spiral, X-Y cross-hatch pattern, K-groove, and K-groove/X-Y groove combination.

7. The pad of claim 1, wherein the openings are continuous in connectivity.

8. The pad of claim 1, wherein the openings are non-continuous in connectivity.

9. The pad of claim 1, wherein the water-soluble, calcium-based binder is selected from the group consisting of calcium acetate and calcium carbonate.

10. A planarizing pad, comprising:

a pad material having a thickness and a plurality of openings extending from a first surface into the pad material, the openings having a depth less than the thickness of the pad, and a fill material partially filling the openings such that the pad material extends beyond a surface of the fill material, the fill material consisting essentially of water-soluble particles within a water-soluble, calcium-based binder, the water-soluble particles selected from the group consisting of high molecular weight sugars, water-soluble salts, water-soluble gums and water-soluble resins, the pad material being devoid of abrasives, the fill material compatible and substantially non-removable with a planarizing solution used with the pad during a planarizing or polishing operation and chemically removable by a composition selective to the fill material relative to the pad material and different than said planarizing solution.

11. The pad of claim 10, wherein the water-soluble particles have a particle size diameter of about 0.05-500 μm.

12. The pad of claim 10, wherein the water-soluble particles comprise a high molecular weight sugar selected from the group consisting of glucose, fructose, mannose, sucrose, lactose, maltose, dextrose, and starch.

13. The pad of claim 10, wherein the water-soluble particles comprise a water-soluble halide salt.

14. The pad of claim 13, wherein the halide salt is an inorganic salt selected from the group consisting of sodium iodide, potassium chloride, potassium bromide and ammonium fluoride.

15. The pad of claim 10, wherein the water-soluble particles comprise a water-soluble gum or resin selected from the group consisting of polyvinyl alcohol, polyvinyl acetate, pectin, polyvinyl pyrrolidone, hydroxyethyl cellulose, methyl cellulose, hydropropylmethyl cellulose, carboxymethyl cellulose, hydroxypropyl cellulose, polyacrylic acid, polyacrylamide, polyethylene glycol, polyhydroxyether acrylate, maleic acid copolymer, and polyurethane.

16. The pad of claim 10, wherein the water-soluble calcium-based binder is selected from the group consisting of calcium acetate and calcium carbonate.

17. The pad of claim 10, wherein the fill material is dissolvable in an organic acid.

18. A planarizing pad, comprising a pad material having a thickness, a surface defining a plurality of openings having a depth of about 50-80% of the pad thickness, and a dissolvable fill material within the openings, the fill material having a surface that is a distance below the pad surface such that the pad material extends beyond said surface of the fill material, the fill material consisting essentially of water-soluble particles within a water-soluble, calcium-based binder, and the water-soluble particles selected from the group consisting of high molecular weight sugars, water-soluble salts, water-soluble gums and water-soluble resins, the pad material being devoid of abrasives, and the fill material compatible and substantially non-removable with a planarizing solution used with the pad during a planarizing or polishing operation and chemically removable by a composition different from said planarizing solution and selective to chemically remove the fill material relative to the pad material.

19. The pad of claim 18, wherein the water-soluble, calcium-based binder is selected from the group consisting of calcium acetate and calcium carbonate.

* * * * *